United States Patent [19]

Chartier

[11] 3,986,746

[45] Oct. 19, 1976

[54] CLAMP

[75] Inventor: Guy Norman Chartier, Toronto, Canada

[73] Assignee: Guy-Chart Tools Limited, Pickering, Canada

[22] Filed: Sept. 23, 1975

[21] Appl. No.: 616,085

[52] U.S. Cl. ..... 294/116; 24/248 C; 24/248 E

[51] Int. Cl.[2] ..... B25B 5/08; B66C 1/48

[58] Field of Search..... 294/85, 86 R, 94, 95, 294/104, 106, 114, 116; 24/132 WL, 134 M, 134 E, 134 EA, 134 CP, 135 N, 136 R, 136 A, 136 B, 248 C, 248 E, 248 SA, 248 SB; 29/253, 262; 104/258; 238/328, 353, 358, 359; 248/226 C, 228, 316 R; 254/24

[56] References Cited

UNITED STATES PATENTS

| | | | |
|---|---|---|---|
| 995,541 | 6/1911 | Kelly | 238/359 X |
| 2,037,589 | 4/1936 | Pilkington | 104/258 |
| 2,383,078 | 8/1945 | Pringle | 294/116 |
| 2,560,929 | 7/1951 | Calbeck | 24/248 E UX |
| 3,744,838 | 7/1973 | Jackson | 294/116 |
| 3,879,814 | 4/1975 | Mojelski | 24/248 C |

*Primary Examiner*—Johnny D. Cherry

[57] ABSTRACT

A clamping attachment for tensile pulling devices has a pair of clamping members designed to be arranged side by side, the members each being designed to provide one of a pair of facing jaws. The clamping members and the jaws are arranged to allow the jaws to grasp a member between them. The jaws are each provided with bores designed to be aligned when they are grasping a member between them and a bolt is provided designed to extend through the aligned bores, the bolt having a head on one end and a nut on the other. Each of the bores at their outwardly facing ends is enlarged to provide a surface defining a cavity at the corresponding entrance to the bores. Bearing members are provided adjacent each and of the bolt designed to contact the respective surfaces of the cavities and to bear thereon as the nut is tightened. The surfaces are shaped to allow the bearing members to move thereover as the bolt moves over a predetermined angular range relative to the clamping member and the bores are made sufficiently larger than the bolt to allow movement over such predetermined angular range. A member is provided for allowing tensile pull on the clamp on the side of the bolt remote from said jaws, the means being designed, upon the exertion of the tensile pull, to tend to spread the jaws at the end thereof remote from said clamping surfaces, whereby the jaws tend to pivot about the bearing members.

2 Claims, 2 Drawing Figures

CLAMP

This invention relates to a clamping means designed to exert clamping pressure on an object when tensile pull is being applied to that object through the clamping means.

The device is of particular importance in the straightening of automobile bodies but is not limited to this use and in fact has many other uses.

The device broadly comprises a pair of clamping members. At one end the clamping members are provided with facing clamping jaws designed to grip an object between them. At the other end the clamping members are provided with connecting means through which the exterior tensile pull may be applied. The clamping members and the connecting means are designed so that their spacing is adjustably limited by a pair of fulcrum members, each fulcrum member being designed to bear inwardly on one of the clamping members. Each fulcrum means and its associated clamping member is designed to allow predetermined relative angular movement. The adjustably spaced fulcrum means act to:

a. limit the separation of the clamping members and b. act as a fulcrum during outward spreading of the jaw-remote end of the clamping members so that the jaws conform (to the degree allowed) to and are compressed about the object to be gripped.

In the preferred embodiment, the fulcrum means referred to above are mounted on a bolt extending through aligned bores in the clamping members and having a nut for adjusting the spacing of the fulcrum means. A clearance between the bolt and the bores in the clamping members allows for a predetermined movement between the clamping members to conform to an object to be gripped.

It is an object of the invention to provide the aforementioned clamping device where the members and fulcrum forming members are designed so that the clamping members have limited universal movement about the bolts. This allows clamping by the jaws about an object of assymetrical form to the extent of the universal movement allowed by the fulcrums so that the clamping pressure may be exerted during the tensile pull on irregularly shaped objects.

In a preferred aspect of the invention, the clamping members are biased away from each other along the bolt. This controls the altitude of the device when not in use and during that application of the clamping pressure achieved by adjusting the spacing of the clamping members along the bolt. The biasing pressure also assists the pivotting of the jaw members about the fulcrum.

In drawings which illustrate a preferred embodiment of the invention:

Figure 1:
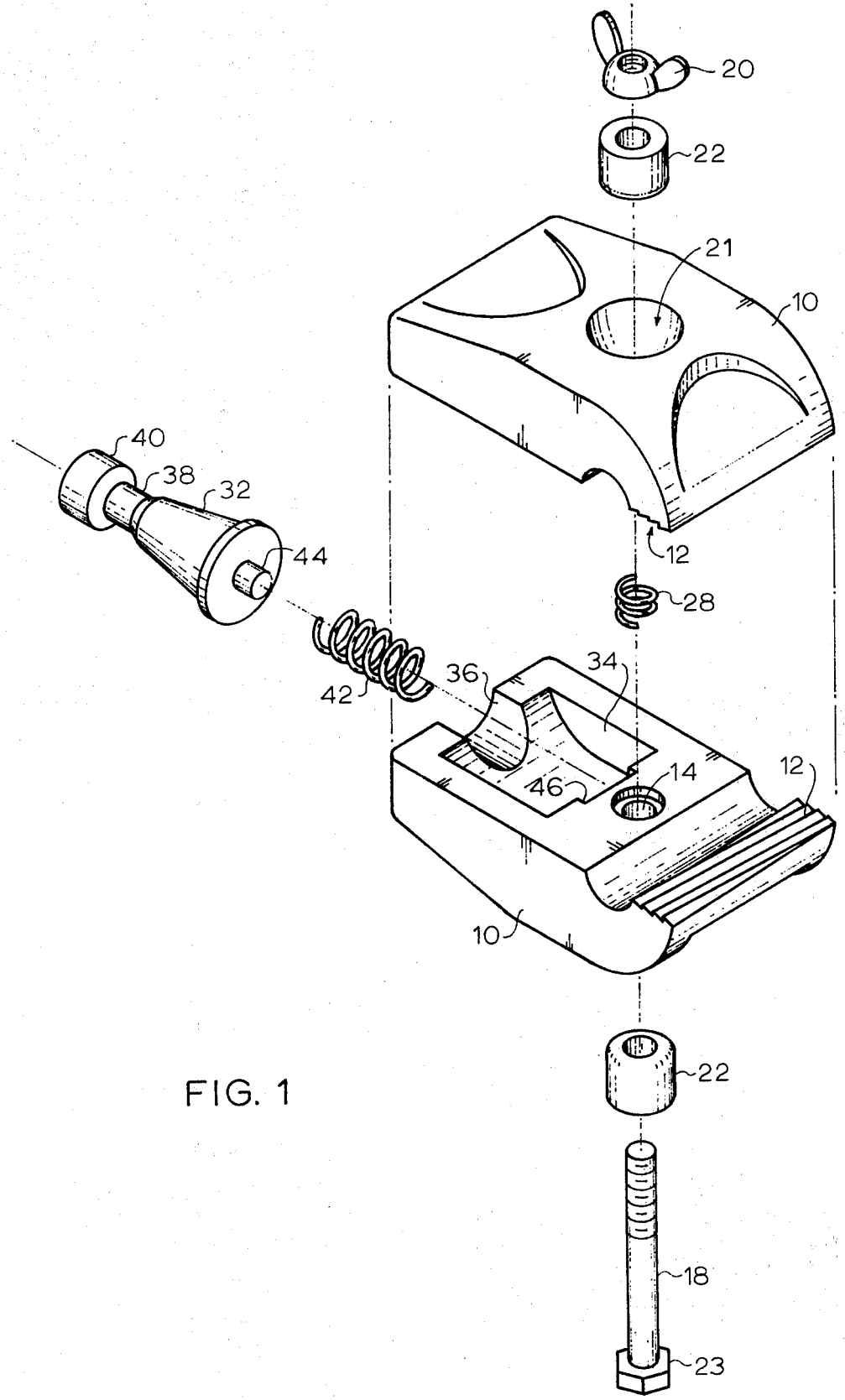
FIG. 1 shows an exploded view of the clamping member.
Figure 2:
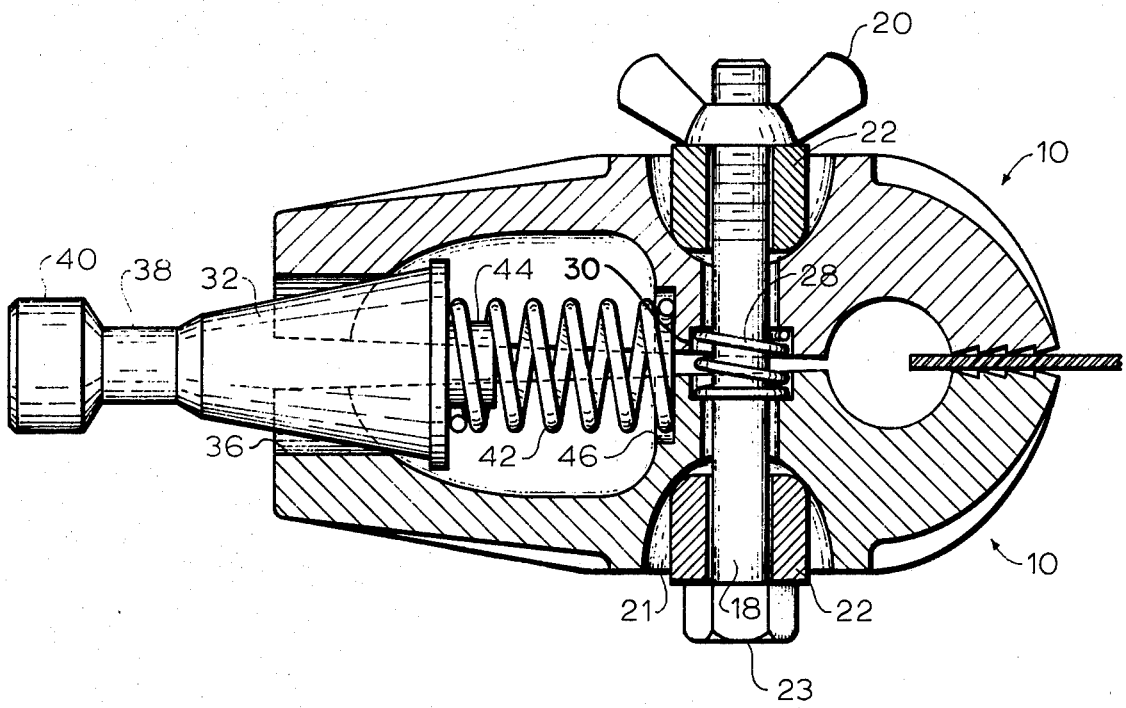
FIG. 2 shows the clamping member clamped about a member to be controlled.

In the drawings FIG. 1 shows a pair of clamping members 10 these members being shaped so that in their functional attitude they are substantially mirror images of each other. The clamping members are designed on what is sometimes referred to herein as the forward end to provide mutually facing clamping jaws 12 at one end. Toward the middle of each clamping member there is provided a bore 14, designed to house a bolt extending therethrough in the direction of clamping pressure, and to align, in the clamping position of the jaws, with the corresponding bore in the other member.

A bolt 18 is designed to extend through the aligned bores 14 and provided with a wing nut 20 (or other conveniently adjustable means) at the end remote from the head. As will be seen adjustment of the wing nut 20 controls the spacing of the clamping members. The outwardly opening end of the bore in each member is provided with an enlarged opening 21 the defining wall of which is shaped to allow the smooth movement of a washer 22 mounted on each end of the bolt for deviation of the bolt axis within a predetermined almost conical locus from its median position. A washer (or fulcrum member) 22 is located on the bolt between the bolt head 23 and one enlarged opening and the other washer (or fulcrum member) 22 is located between the wing nut and the other enlarged opening. The washers 22 are each shaped to slide easily on the defining walls of the enlarged openings and to act as the fulcrum members about which the clamping members may move angularly through a limited angular range relative to the bolt. As will be noted the clearance between the bolt 18 and the bore is designed to allow predetermined angular deviation of the bolt about its median position. A compression spring 28 is located about the middle extent of the bolt and bears at each end on the facing walls of a recess 30 in the clamping member. The spring 28 acts to bias the clamping members 10 apart to the limits allowed by the bolt head and wing nut.

The clamping members 10 are shaped to define between them a cavity to receive (with spacing between the clamping members as indicated) the large end of a rearwardly tapering conical tension applying member 32. As shown, the facing walls 34 defining the cavity tapered toward the end of the clamping member remote from the jaws so that the tension applying member bears on the tapering walls. The exit of the conical member from between the clamping members is provided for by facing concave cylindrical groove 36 in the clamping member, partially defining a cylindrical bore. The conical member 32 at the outward extremity of its movement bears on the inner edge of the groove to spread the jaw remote ends of the clamping member when the conical member is outwardly (i.e. rearwardly) disposed. The conical member 32 is provided at its outer end with a thin shank 38 and a wide end 40 for easy coupling to a tension applying member. Alternative coupling means may of course be provided. A compression spring 42 is provided to bear rearwardly on the conical member 32 and forwardly on the clamping members 10 to bias the former to its most rearward position allowed by the adjustment of the wing nut on the bolt. To mount the spring 42 in position, the forward side of the conical member is provided with a forwardly directed boss 44 to mount the spring thereabout and the rearward cavity defining faces of the clamping members are shaped to define a recess 46 to receive the forward end of the spring 42.

In operation, before rearward tension is applied to the clamp, the two clamping members achieve the attitude determined by the bias of the compression spring 28 separating the members 10 at the bolt, and the compression spring 42 biases the conical member 32 rearwardly to spread the clamping members 10 at their rearward end. The result will have the jaws in contact. When it is desired to apply tensile pull to an object, the wing nut 20 will be loosened so that the jaws 12 may be placed on each side of the object to be grasped with the jaws if necessary being spread by moving the conical member 32 farther forward against spring 42. The members are then clamped about the object to be pulled by tightening the wing nut 20. It will be noted that the washers 22 riding on the walls of the concave outward cavities act as fulcrums so that the clamping may be achieved about an object thicker on one side than the other with the clamping members 10 pivoting relative to the bolt and to each other to conform to the limits allowed by the bolt clearance from the clamping members. Any tendency toward slack in the rearward end of the clamp is taken care of by the spring 42 rearwardly biasing the conical member 32.

With the object thus clamped, tension is applied to the rearwardly projecting portion of the conical member 32 and the conical member partially drawn out of its cavity. The wedging action provided by the conical member 32 causes the spreading of the rearward ends of the clamping members 10. During such spreading the washers 22 on the bolt 18 act as fulcrums so that the clamping of the jaws on the piece being operated on is increased.

Thus the washer members 22 and the concave cavities act as fulcrums to increase the clamping pressure and to allow the jaws to adjust to irregularly shaped work piece. The compression springs act to maintain the attitude of the device.

I claim:

1. Clamping attachment for tensile pulling device comprising:

a pair of clamping members designed to be arranged side by side, said members being each designed to provide one of a pair of facing jaws;

said members and said jaws being arranged to allow said jaws to grasp a member between them;

said jaws being each provided with bores designed to be aligned when said jaws are grasping a member between them;

a bolt member being designed to extend through said aligned bores, each of said bores, at their outwardly facing ends, being enlarged to provide a surface defining a cavity at the corresponding entrance to the bores, bearing members adjacent each end of said bolt designed to contact the respective surfaces of said cavities and to bear thereon;

said enlarged bore surfaces being shaped to allow said bearing members to move thereover as said bolt moves over a predetermined angular range relative to said clamping members, said bores being made sufficiently larger than said bolt to allow such predetermined limited angular movement;

means for allowing tensile pull on said clamping attachment on the side of said bolt remote from said jaws, said means allowing tensile pull comprising a conical member designed to have its wider end received between said clamping members at the end thereof remote from said jaws, and to have its narrow end project outwardly from between said clamping members at said remote end, means attached to said narrow end to allow connection of said conical member to a tensile pulling member, said clamping members at the end remote from said jaws being shaped to define a cavity to receive the large end of said conical members and to define means on which said conical member bears;

whereby the application of tensile pull on said connection allowing means said conical member acts to spread the jaw remote ends of said clamping members.

2. A device as claimed in claim 1 including means designed to bias said clamping members outwardly along said bolt.

* * * * *